US005803093A

United States Patent [19]

Romano

[11] Patent Number: 5,803,093

[45] Date of Patent: Sep. 8, 1998

[54] HAIR/SCALP TREATMENT DEVICE

[76] Inventor: Jason Romano, 309 Classen Dr., Dallas, Tex. 75218

[21] Appl. No.: 442,981

[22] Filed: May 17, 1995

Related U.S. Application Data

[63] Continuation-in-part of Ser. No. 365,203, Dec. 28, 1994, abandoned.

[51] Int. Cl.[6] ..... A45D 24/22

[52] U.S. Cl. ..... 132/116; 132/115; 132/152; 132/151; 132/114

[58] Field of Search ..... 132/111, 112, 132/113, 114, 115, 116, 161, 219, 151, 152; D28/31, 21; 215/330, 209; 401/291, 190

[56] References Cited

U.S. PATENT DOCUMENTS

| | | | |
|---|---|---|---|
| D. 244,712 | 6/1977 | Houston | D30/40 |
| D. 353,019 | 11/1994 | Kimmell et al. | D28/25 |
| 753,968 | 3/1904 | Farmer . | |
| 841,175 | 1/1907 | Phinney | 132/114 |
| 859,711 | 7/1907 | Winsor . | |
| 1,065,814 | 6/1913 | Lambert . | |
| 1,106,411 | 8/1914 | Scheel . | |
| 1,252,499 | 1/1918 | Scheel . | |
| 1,847,619 | 3/1932 | Mascolo . | |
| 1,956,769 | 5/1934 | Maselli | 132/113 |
| 2,507,386 | 5/1950 | Spiegel | 132/9 |
| 2,517,152 | 8/1950 | Wilson | 15/131 |
| 3,059,652 | 10/1962 | Thomas | 132/112 |
| 3,066,683 | 12/1962 | Pace | 132/114 |
| 3,353,721 | 11/1967 | Love | 222/209 |
| 3,520,311 | 7/1970 | Lesersek et al. | 132/111 |
| 3,570,499 | 3/1971 | Ruta | 132/9 |
| 4,881,558 | 11/1989 | Hollenberg et al. | 132/112 |
| 4,917,129 | 4/1990 | Olson | 132/161 |
| 5,042,514 | 8/1991 | Bastien | 132/270 |
| 5,056,480 | 10/1991 | Murray, Sr. | 132/112 |
| 5,067,501 | 11/1991 | Auger | 132/116 |
| 5,116,253 | 5/1992 | Charitar et al. | 132/114 |
| 5,195,545 | 3/1993 | Thibodeaux | 132/116 |
| 5,297,565 | 3/1994 | Charitar et al. | 132/114 |
| 5,482,058 | 1/1996 | Garconnet | 132/116 |

*Primary Examiner*—Gene Mancene
*Assistant Examiner*—Pedro Philogene
*Attorney, Agent, or Firm*—Seed and Berry LLP

[57] ABSTRACT

A comb structure has a primary, longitudinally extending tube, and a plurality of transversely extending tubes. The primary tube has a fitting secured at one end and is closed at the other, while the secondary tubes have ports at their free ends. The fitting is manually securable to a top of a squeeze bottle that contains a hair treatment chemical. The comb structure is of unitary construction and is manually secured to the bottle with sufficient mechanical strength that the comb structure and the bottle form a single device that can be used under single-handed operation.

11 Claims, 6 Drawing Sheets

HAIR/SCALP TREATMENT DEVICE

CROSS-REFERENCE TO RELATED APPLICATION

This application is a continuation-in-part of application Ser. No. 08/365,203, filed on Dec. 28, 1994, now abandoned.

TECHNICAL FIELD

The present invention relates to a method and apparatus for selectively applying a fluid to desired locations. More particularly, the present invention relates to an apparatus and method for applying a fluid, paste or other product to a user's scalp or roots of her hair.

BACKGROUND OF THE INVENTION

People with curly or kinky hair often desire to straighten their hair using currently available hair relaxant chemicals. After having once relaxed the hair, it grows out from the scalp, resulting in new hair growth that is curly while the remainder of the hair is straight. To straighten the new hair growth, hair relaxant is sequentially and selectively applied only to the new hair growth. Another person, such as a beautician, is generally required to selectively apply the hair relaxant.

Similarly, people change the color of their hair using dyes or bleaches. After having once dyed the hair, it grows out from the scalp, resulting in new hair growth that is undyed, and which contrasts with the previously dyed hair. To dye the new hair growth, additional dye must be selectively applied to the new hair growth. Again, another person such as a beautician, is generally hired to selectively apply the dye to the person's hair roots.

The cost of hiring a beautician or other individual to relax or dye new hair growth can be expensive. While some people can apply hair relaxant or dye to their own new hair growth, such self-application can be awkward, difficult, and often produce less than ideal results. Furthermore, certain hair treatment chemicals can irritate the user's scalp. Therefore, one often chooses to hire a beautician to accurately and quickly apply such chemicals. The beautician themselves, however, can often not apply irritating chemicals as quickly as necessary for individuals having particularly sensitive scalps.

Accordingly, there is a need for an apparatus and method of applying hair relaxants or dyes that may be self-administer able. Additionally, there is a need for a method and apparatus that rapidly applies hair relaxant or dye to a user's scalp or the roots of her hair.

SUMMARY OF THE INVENTION

The present invention comprises a comb structure having a primary, longitudinally extending tube, and a plurality of transversely extending tubes. The primary tube has a fitting secured at one end and is closed at the other end. The secondary tubes taper from the primary tube to nozzles at their free ends. A squeeze bottle is coupled to the fitting, so that as the bottle is squeezed, the fluid is forced into the primary tube and out through the secondary tubes as the user combs the secondary tubes through her hair.

As represented in the claims below, the present invention, in a broad sense, embodies a hand-held treatment device for distributing a fluid from an external dispenser to a user's hair or scalp. The device includes a longitudinally extending main body of a rigid material having a single central channel that is closed at one end and open at the other. A plurality of coplanar fingers extend transversely from the main body at a first end. Each of the coplanar fingers includes a dispensing channel communicating with a single central channel, and a port at a free end. The longitudinally extending main body includes a fitting portion which is received by the open end of the main body and which is manually securable to an external dispenser to form a manually operable device. The fitting portion is secured to the dispenser to permit fluid dispensed through the fitting portion to travel through the single central channel through the dispensing channels, and out of the ports.

The present invention also embodies a method of applying a fluid to a user's scalp or hair roots. The method includes the steps of: (i) providing a container containing a treatment fluid; (ii) providing a treatment device having a longitudinally extending main tube having a central channel and a fitting portion, and a plurality of transversely extending secondary tubes, each secondary tube having a port and a dispensing channel that communicates with the central channel; (iii) mechanically securing the fitting portion of the treatment device to the container; (iv) positioning the treatment device proximate to the user's scalp or hair roots; (v) pressurizing the container; (vi) forcing the treatment fluid through the fitting, the central channel, the dispensing channels, and out of the ports; and (vii) applying the fluid directly to a user's hair roots or scalp.

Other features and associated advantages of the present invention will become apparent from studying the following detailed description, together with the accompanying drawings.

DETAILED DESCRIPTION OF THE INVENTION

Figure 1:
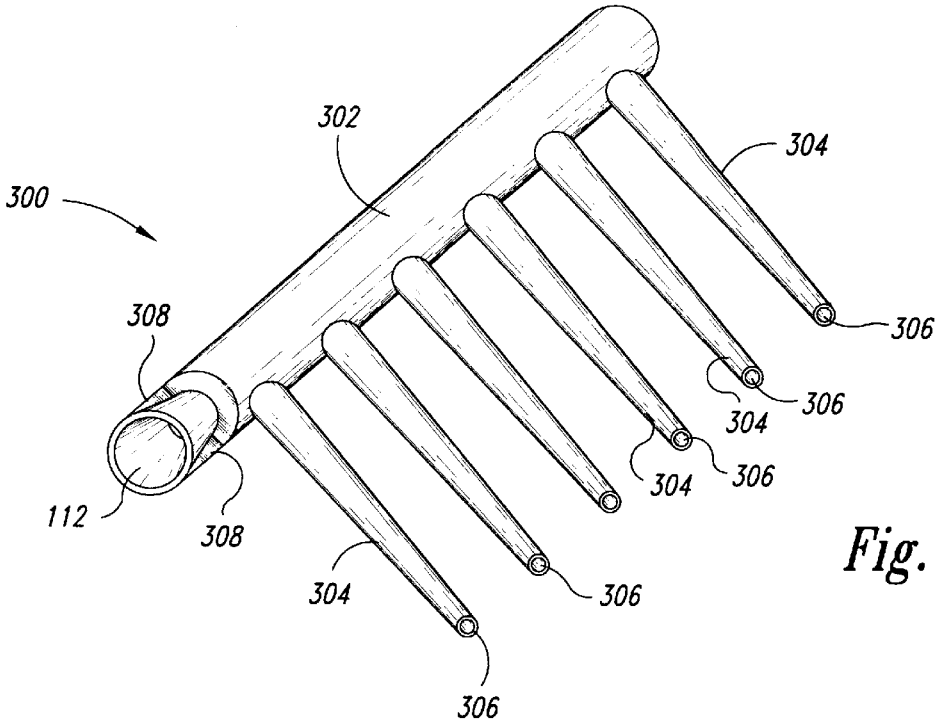
FIG. 1 is an isometric view of a hair/scalp treatment device of the resent invention.
Figure 3:
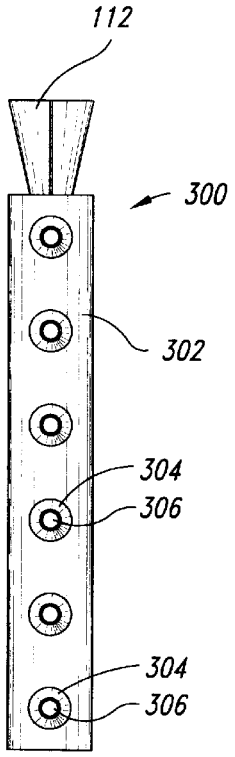
FIG. 3 is a front elevational view of the device of FIG. 1.
Figure 2:
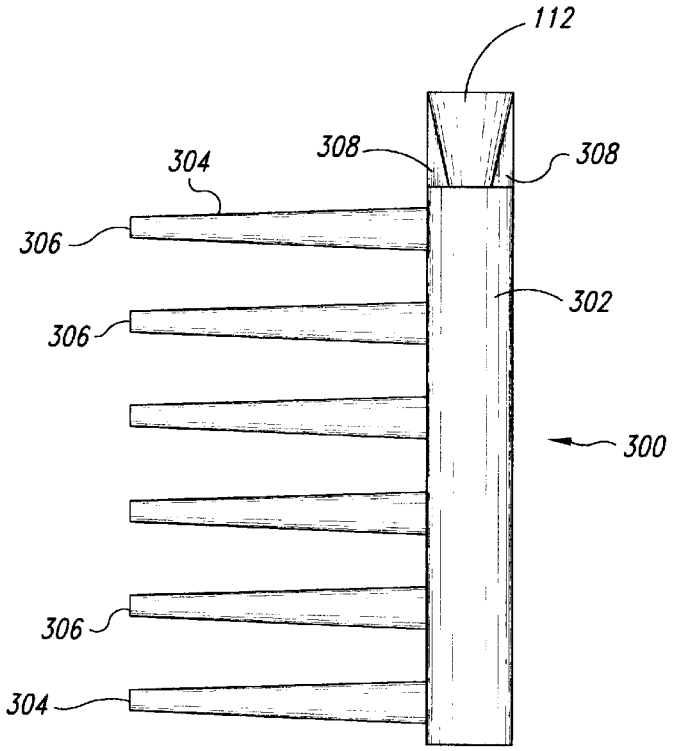
FIG. 2 is a left side elevational view of the device of FIG. 1.

As shown in FIGS. 1 through 4, a hair/scalp treatment device 300 for applying a fluid to a user's scalp, or the roots of the user's hair, includes as longitudinally extending main body 302 having a single central channel therethrough. The main body has an approximately elongated, cylindrical shape that is readily held by the user's hand (e.g. about 8 cm long). The main body 302 is closed at one end and at an open end includes a fitting 112.

Several spaced apart fingers 304 extend from the main body 302 at a first end of the fingers. Each finger 304 has a dispensing channel therethrough that communicates with the single central channel in the main body 302. The fingers 304 each have a port 306 at a free end. The fingers 304 preferably taper from the first end to the port 306 at the free end (from about a diameter at 0.234" to about 0.117"). The fingers 304 are spaced apart and coplanar so as to form a substantially comb-like structure. The fingers 304 are each approximately 4.5 cm long, and the device 300 preferably has 6 fingers that are equally spaced along the main body 302.

Figure 5:
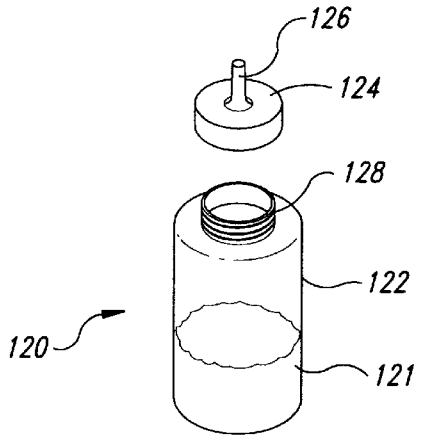
FIG. 5 is a reduced scale, isometric view of a fluid dispenser for use with the hair/scalp treatment device of FIG. 1.

Referring to FIG. 5, a typical dispenser 120 for manually providing a hair treatment chemical or other fluid 121 is shown as having a manually squeezable fluid container or bottle 122 for holding the fluid and a cap 124 with a nozzle 126. The fluid container 122 preferably has a sufficient volume to accommodate enough fluid to both fill the central and dispensing channels, and to apply a sufficient amount of the fluid 121 to a user's head (about 5 cm diameter and 10 cm high). The cap 124 is preferably a Yorker style top, known to those skilled in the relevant art. The cap 124 is preferably manually securable to the bottle 122 by means of, for example, threads 128 at a top portion of the bottle. Alternatively, the dispenser 120 may be of unitary construction.

The fittings 112 securely or tightly receive the nozzle 126 so that as the bottle 122 is squeezed, the squeezing force forces the fluid 121 through the nozzle 126 and the fitting 112, into the central channel within the main body 302, through the dispensing channels within the fingers 304, and out through the ports 306. A user simultaneously combs the fingers 304 through her hair as she squeezes the fluid container 122 causing the fluid 121 to be forced into the central channel of the main body 302, through the dispensing channels of the fingers 304 and out through the ports 306. Since the fluid 121 is forced simultaneously through the fingers 304, the user can quickly and simultaneously apply the fluid to a large portion of the user's hair or scalp.

The device 300, and other embodiments described herein, allow the user to apply the fluid 121 to difficult, hard to reach portions of the user's head, for example, the back of the head. The present invention allows more accurate application of the fluid 121 to selected portions of the user's hair or scalp over known manual methods. Additionally, since the present invention allows the fluid 121 to be accurately applied to selected portions of the user's head, less fluid is generally required than known manual methods.

The hair/scalp treatment device 300 has been found to provide even fluid distribution, especially if the fluid 121 is viscous. The particular viscosity of the fluid 121 may be required to be modified in light of aspects of the present invention, such as the diameter of the ports 306, so as to provide for even fluid distribution during operation of the device. The viscosity of the fluid 121 may be required to be lessened so as to reduce the possibility of forming vacuum forces in the bottle 122 after it has been squeezed.

The fitting 112 is coaxial with the longitudinally extending main body 302 to promote fluid flow therethrough (as opposed to providing the fitting at an angle, which would cause the fluid 121 to move through such an angle). A pair of opposing supports 308 project from and are secured to the fitting 112. The supports 308 are also secured to the main body 302 so as to strengthen the fitting's attachment to the main body 302.

Figure 4:
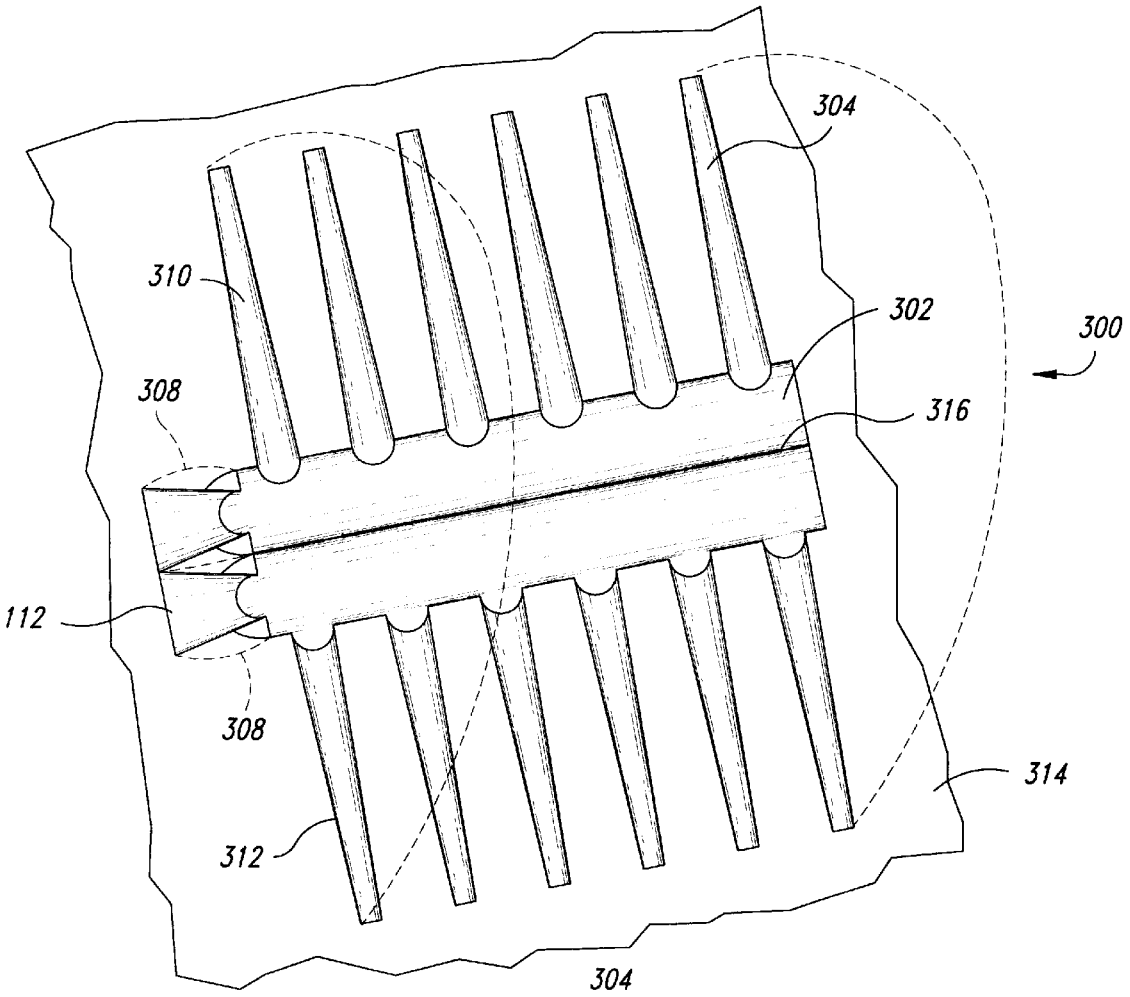
FIG. 4 is an isometric view of the device of FIG. 1, shown partially formed in a sheet of plastic.

The hair/scalp treatment device 300 is preferably of unitary, rigid construction. The rigidity and wide diameter channels of the treatment device 300 promote flow of viscous fluids throughout the device. Referring to FIG. 4, the hair/scalp treatment device 300 is shown as having left and right halves 310 and 312, respectively, molded or thermoformed in a rigid sheet of plastic 314. The plastic is preferably about 15 mil thick. The left and right halves 310 and 312 are cut from the sheet of plastic 314, and folded along a center line 316 between halves of the main body 302, so that the free ends of the fingers 304 are joined as shown by the dashed lines in FIG. 4. The edges of the halves 310 and 312 are then fused or heat sealed together so as to form the hair/scalp treatment device 300 shown in FIGS. 1 through 3. The opposing supports 308 are preferably coplanar with the fingers 304, and the left and right halves 310 and 312, so that they can be readily cut from the sheet of plastic 314 without additional molding/forming.

One side of the rigid sheet of plastic 314 preferably has a matte finish, while the other side, forming the interior of the device 300, has a smooth finish. The matte finish allows the device 300 to be readily gripped by a user, particularly when a user's hands are wet. The smooth finish, within the primary and dispensing channels, promotes fluid flow through the device 300. The sheet of plastic 314 can be of a transparent or translucent plastic to allow the user to view the distribution of the fluid 121 through the device. The thickness of the sheet of plastic 314 is preferably such that it provides sufficient structural strength to the device 300, but yet is thin enough so that the device can have a reduced material cost, be inexpensive and be disposable.

Figure 6:
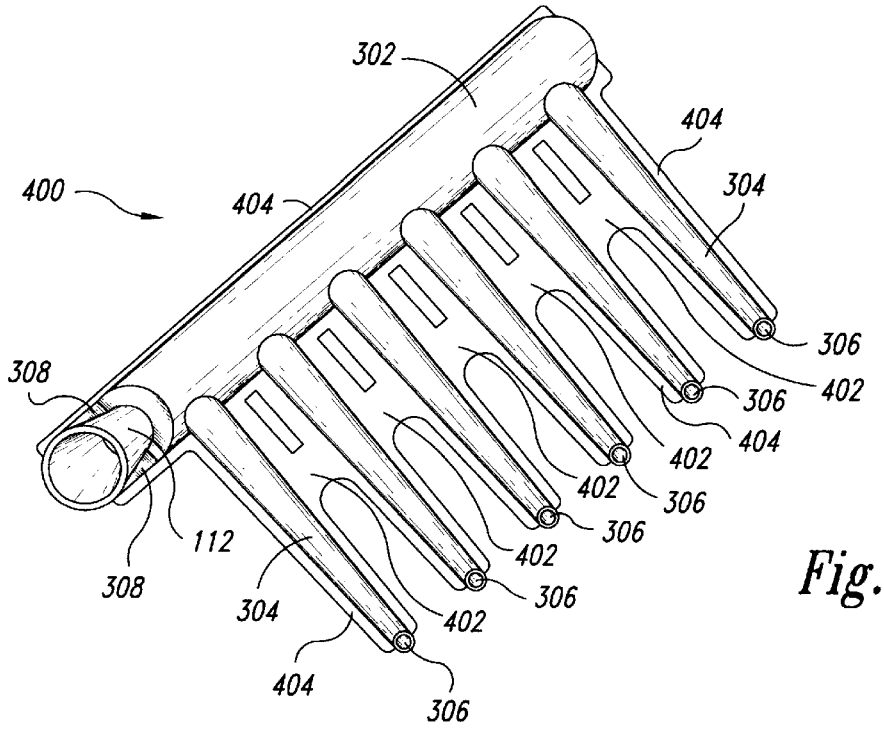
FIG. 6 is an isometric view of a first alternative embodiment of the hair/scalp treatment device of the present invention.

A first alternative embodiment at the hair/scalp treatment device of the present invention is shown in FIG. 6 as device 400. This alternative embodiment, and all alternative embodiment described herein, are similar to the previously described embodiment, and elements will be similarly numbered when of similar construction. Only the differences in construction will be described in detail.

The device 400 is similar to the device 300 except that it further strengthens the device 300 against torsional sheering and other forces by adding interstitial or web members 402 between the fingers 304. As with the supports 308, the web members 402 may be readily cut from the sheet of plastic 314 without additional molding or forming. The web members 402 extend approximately half-way between the first end of the fingers 304 (at the main body 302) to the ports 306. To further strengthen the device 400 without requiring additional molding or forming, a peripheral support 404 extends along a periphery of the device 400, coplanar with the fingers 302. In addition to providing structural support, the web members 402 prevent the user's hair from becoming entangled in the gap between the fingers 304 and the main body 302.

Figure 7:
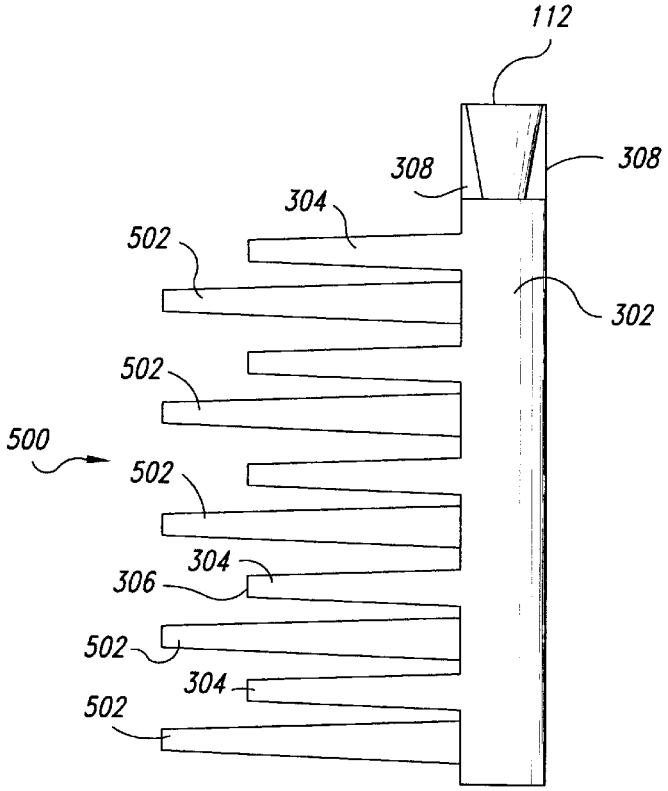
FIG. 7 is a left side elevational view of a second alternative embodiment of the hair/scalp treatment device of the present invention.
Figure 8:
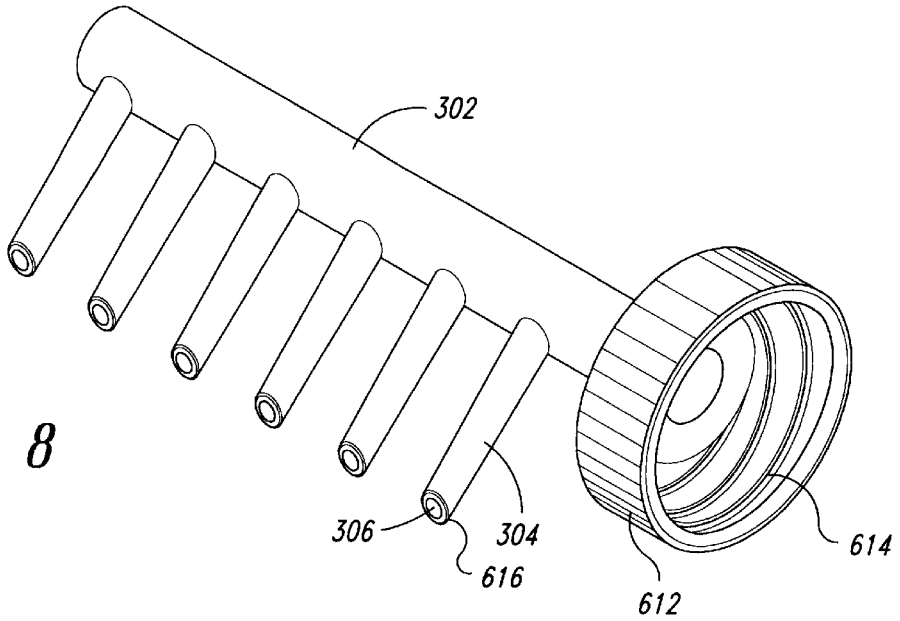
FIG. 8 is an isometric view of a third alternative embodiment of the hair/scalp treatment device of the present invention.
Figure 10:
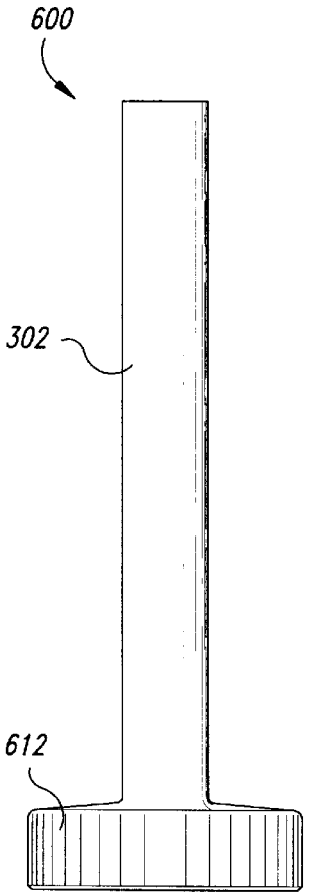
FIG. 10 is a right-side elevational view of the device of FIG. 8.
Figure 9:
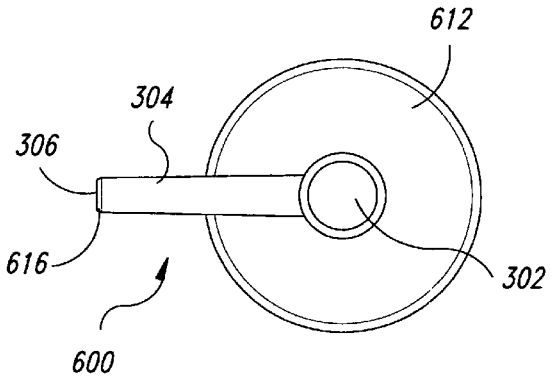
FIG. 9 is a top plan view of the device of FIG. 8.
Figure 13:
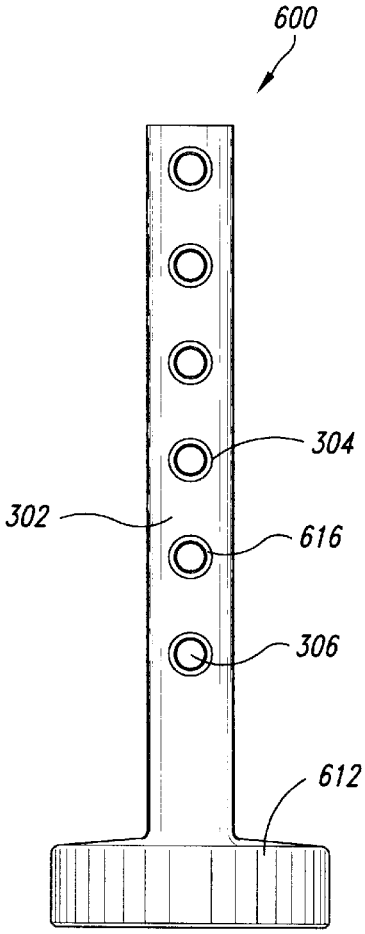
FIG. 13 is a left-side elevational view of the device of FIG. 8.
Figure 11:
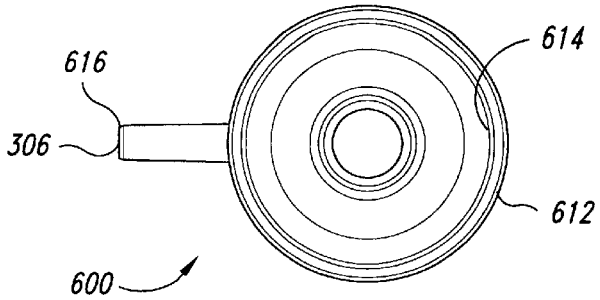
FIG. 11 is a bottom plan view of the device of FIG. 8.
Figure 12:
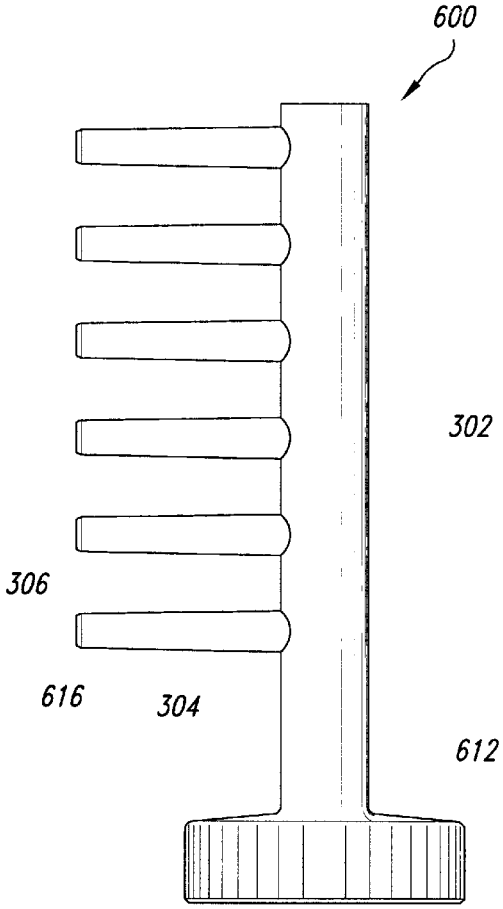
FIG. 12 is a front elevational view of the device of FIG. 8.

A second alternative embodiment of the hair/scalp treatment device of the present invention is shown in FIG. 7 as device 500. The hair/scalp treatment device 500 is substantially similar to the device 300, except that the device 500 includes several prongs 502 extending transversely from the main body 302 and between the fingers 304. The prongs 502 extend a distance greater than the distance extended by the fingers 304. The prongs 502 are preferably coplanar with the fingers 304 and thus can be manufactured simultaneously with the fingers in the sheet 314. The prongs 502 space the ports 306 from the user's scalp so that, in use, the fluid 121 exiting from the ports is distributed to the roots of the user's hair, and not directly to her scalp. The prongs 502 preferably extend a distance of approximately 0.5 cm beyond the fingers 304.

A third alternative embodiment of the hair/scalp treatment device of the present invention is shown in FIGS. 8 through 13 as device 600. The hair/scalp treatment device 600 is substantially similar to the device 300, except that the device 600 includes a fitting 612 capable of being manually secured to the top of the bottle 122. The fitting 612 preferably includes threads 614 that mate with the threads 128 to provide a mechanically secure and fluid-tight connection between the fitting and the bottle 122. The fitting 612 is coaxial with, and formed at the opened end of, the longitudinally extending main body 302, as if the cap 124 (FIG. 5), without the nozzle 126, were affixed to the main body. The device 600 is preferably of unitary, rigid construction, formed by injection molding with an outer matte or "sandblast" finish to provide a secure gripping surface for a user's hand.

Each finger 304 has a smooth or rounded outer edge 616 at the free end, concentric with a port 306. The rounded edge 616 provides a rounded surface that may more easily be passed through the user's hair. The rounded edges 616 of the fingers 304 also prevent the fingers from cutting into or scraping against the user's scalp.

Unlike the fingers 304 of the device 300, the fingers of the device 600 do not taper along their exterior. However, the dispensing channel formed through each finger 304 tapers from the first end to the port 306 at the free end. Therefore, the dispensing channel in each finger 304 has a diameter at the central channel that is smaller than a diameter at the port 306 (e.g., about 0.123 inch at the first end versus about 0.156 inch at the port). Such a tapering of the dispensing channels provides uniform fluid flow throughout all of the fingers 304. Such a tapering from the ports 306 to the first end also allows the device 600 to be more readily injection molded.

The device 600 provides a reduced part count over the device 300, since it avoids the cap 214. Additionally, since the device 600 is manually secured to the bottle 122 by means of the fitting 612, the device with the bottle attached thereto provides a single manually operable device that allows for single-handed use. A user can single-handedly grasp the bottle 122, or both the bottle and the main body 302, and pass the fingers 304 through her hair while simultaneously squeezing the bottle to dispense the fluid 121 through the ports 306. The fitting 612 preferably has sufficient structural rigidity, and sufficient mechanical intercoupling with the bottle 122 so that the device 600 remains mechanically secured to the bottle despite transverse forces exerted by the user, transverse to the main body 302, as the user combs the fingers 304 through her hair.

Figure 14:
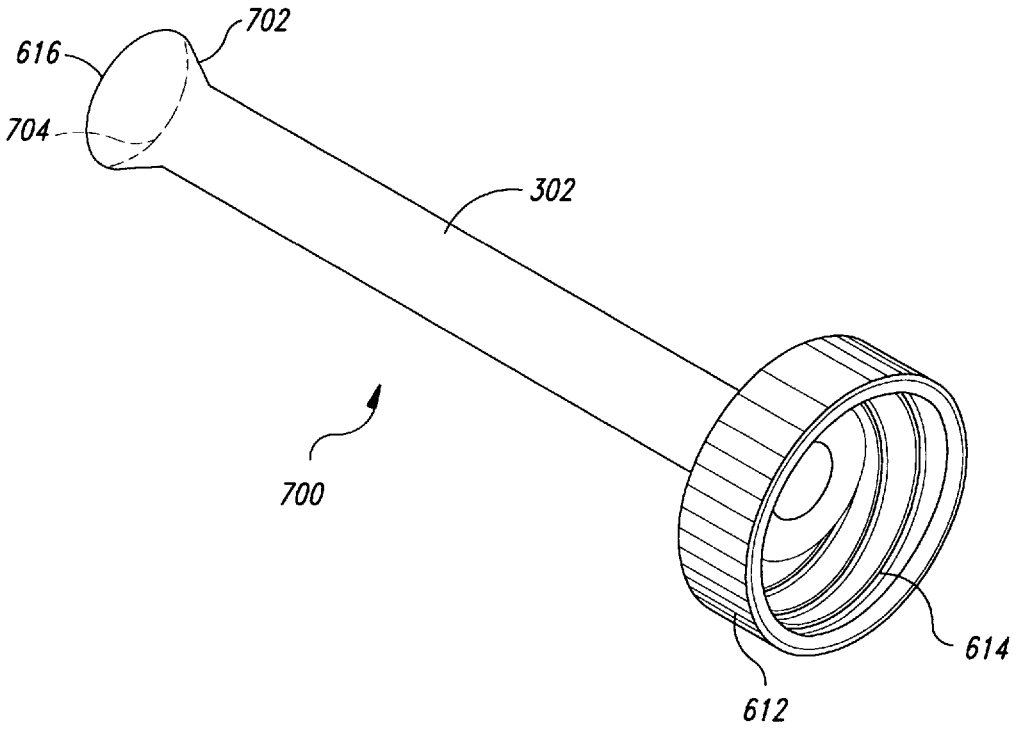
FIG. 14 is an isometric view of a fourth embodiment of the hair/scalp treatment device of the present invention.

A fourth alternative embodiment of the hair/scalp treatment device of the present invention is shown in FIG. 14 as device 700. Rather than employing the fingers 304, the device 700 includes only the main body 302 having the fitting 612 secured at one end and a beveled smoothing nozzle 702 secured at the other end. The smoothing nozzle 702 preferably has a slit-like opening 704 so that as the fluid 121 is forced through the central channel, the fluid is forced out of the slit-like opening 304 to provide a wide ribbon-like application of fluid to the user's head. While the device 700 lacks the plurality of fingers 304 that simultaneously provide the fluid 121 to a wide area of the user's head, the smoothing nozzle 702 can still provide fluid to a larger area than if a single smaller port were employed. The smoothing nozzle 702 preferably has a rounded outer edge 616 that prevents the nozzle from scraping against the user's scalp and also allows the user to smooth the fluid over an area of the user's scalp in a circular or brush-like manner. The device 700 can be more readily used with highly viscous fluids 121 than the above-described devices.

Those skilled in the art will recognize that numerous modifications and variations of the hair/scalp treatment device disclosed herein are possible based on the present detailed description. For example, the supports 308 of the device 300, the web members 402 of the device 400 and/or the prongs 502 of the device 500 can be added to the device 600 to provide the above-described benefits of the supports, web members and prongs. Additionally, while the device 600 is preferably of unitary construction, injection molded from a single type of rigid plastic, the device instead could be formed of two types of plastic. As a result, the main body 302 and the fitting 612 are formed of the rigid plastic, but the fingers 304 are formed of a less rigid plastic, such as an elastomer, so that the fingers are less abrading and irritating to the user's scalp. Furthermore, while the present invention is generally described as applying a hair treatment fluid such a relaxant or dye to the user's hair, the present invention can be used to apply any fluid or powder, even pharmaceuticals, to a desired location (e.g., beneath the fur of an animal). Accordingly, those skilled in the art will understand that modifications and variations, and equivalents thereof, can be practiced while remaining within the spirit and scope of the invention as defined by the following claims.

I claim:

1. A hand-held treatment device for distributing a fluid to the roots of a user's hair or scalp, the device comprising:

a manually squeezable fluid container having a threaded top portion and a single chamber for receiving, containing, and dispensing a viscous fluid, the container being directly manually squeezable;

a longitudinally extending main body of a rigid material, the main body having a length, a single central channel, a closed end and an open end, the channel having a substantially equal cross-sectional area sufficient to permit passage of the viscous fluid;

less than ten spaced apart, coplanar fingers of approximately equal length extending transversely from the main body at a first end, each finger having a length approximately half the length of the main body, each finger having a dispensing channel communicating with the single central channel, and a port at a free end, the dispensing channel having a cross-sectional area sufficient to permit passage of viscous fluids, the free end located in a region of the finger furthest from the main body, the port and at least a portion of the dispensing channel adjacent to the port having a diameter of approximately 0.15 inch to permit passage of the viscous fluid, the fingers spaced apart a distance approximately equal to the port diameter, wherein each of the free ends of the plurality of coplanar fingers have a rounded edge that is concentric with the port, and wherein each finger has a substantially parallel outer surface profile extending between the main body and the port;

a fitting joined to the open end of the longitudinally extending main body at a joint and threadably securable to the top portion of the container to form a substantially fluid-tight connection between the main body and the container, wherein the fitting is coaxial with the longitudinally extending main body, and wherein the container, the longitudinally extending main body, the plurality of spaced apart, coplanar fingers and the fitting together form a manually operable device, the fitting being secured to the top portion to permit fluid in the container to be forced, as the container is squeezed, through the fitting, through the single central channel, through the fluid dispensing channel and out of the ports, so that the fluid can be applied directly to the roots of the user's hair; and a plurality of supports connected to the fitting and the longitudinally extending main body in the region where the fitting and the longitudinally extending main body are joined, for structural support of the joint between the longitudinally extending main body and the fitting, the fitting, supports, coplanar fingers and longitudinally extending main body being of unitary construction.

2. The hand-held treatment device of claim 1 wherein the longitudinally extending main body, the plurality of spaced apart, coplanar fingers and the fitting are formed from a single formed sheet folded along a fold line.

3. The hand-held treatment device of claim 1, further comprising a plurality of prongs extending from the longitudinally extending main body and between, and coplanar with, the coplanar fingers, the prongs extending a distance greater than a distance extended by the coplanar fingers, the prongs contacting the user's scalp during use, and the ports being offset from the user's scalp during use.

4. The hand-held treatment device of claim 1 wherein the longitudinally extending main body has an approximately elongated, cylindrical shape to be readily held in the user's hand, and the plurality of spaced apart, coplanar fingers taper from the free end to the first end.

5. The hand-held treatment device of claim 1 wherein the top portion of the container contains threads, and wherein the fitting has threads that are manually securable to the threads of the top portion of the container.

6. The hand-held treatment device of claim 1 wherein the longitudinally extending main body has an outer surface and an inner surface, wherein the outer surface is grippable by the user and has a matte texture for easier gripping by the user, while the inner surface has a smooth finish.

7. The hand-held treatment device of claim 1 wherein the longitudinally extending main body has an outer surface having a matte texture.

8. A hand-held treatment device for distributing a fluid from a manually squeezable container to the roots of a user's hair or scalp, the device comprising:

a longitudinally extending main body of a rigid material, the main body having a length, a single central channel, a closed end and an open end, the channel having a substantially equal cross-sectional area sufficient to permit passage of the viscous fluid;

less than ten spaced apart, coplanar fingers of approximately equal length extending transversely from the main body at a first end, each finger having a length approximately half the length of the main body, each finger having a dispensing channel communicating with the single central channel, and a port at a free end, the dispensing channel having a cross-sectional area sufficient to permit passage of viscous fluids, the free end located in a region of the finger furthest from the main body, the port and at least a portion of the dispensing channel adjacent to the port having a diameter of approximately 0.15 inch to permit passage of the viscous fluid, the fingers spaced apart a distance approximately equal to the port diameter, wherein each of the free ends of the plurality of coplanar fingers have a rounded edge that is concentric with the port, and wherein each finger has a substantially parallel outer surface profile extending between the main body and the port;

a fitting joined to the open end of the longitudinally extending main body at a joint and threadably securable to the container to form a substantially fluid-tight connection between the main body and the container, wherein the fitting is coaxial with the longitudinally extending main body, and wherein the container, the longitudinally extending main body, the plurality of spaced apart, coplanar fingers and the fitting together form a manually operable device, the fitting being secured to the container to permit fluid in the container to be forced, as the container is squeezed, through the fitting, through the single central channel, through the fluid dispensing channel and out of the ports, so that the fluid can be applied directly to the roots of the user's hair; and a plurality of supports connected to the fitting and the longitudinally extending main body in the region where the fitting and the longitudinally extending main body are joined, for structural support of the joint between the longitudinally extending main body and the fitting, the fitting, supports, coplanar fingers and longitudinally extending main body being of unitary construction.

9. The hand-held treatment device of claim 8 wherein the longitudinally extending main body is of unitary construction and of a rigid material formed from a single formed sheet folded along a fold line.

10. The hand-held treatment device of claim 8, further comprising a plurality of prongs extending from the longitudinally extending main body and between the coplanar fingers, the prongs extending a distance greater than a distance extended by the coplanar fingers, the prongs contacting the user's scalp during use, and the ports being offset from the user's scalp during use.

11. The hand-held treatment device of claim 8, further comprising a plurality of interstitial members extending a substantial distance between each pair of fingers and from the longitudinally extending main body, wherein the interstitial members provide rigidity and structural support of the fingers.

* * * * *